US005141285A

United States Patent [19]

Park

[11] Patent Number: 5,141,285

[45] Date of Patent: Aug. 25, 1992

[54] RELAXATION CHAIR

[76] Inventor: Brian Park, 2 Burr St., Portland, Conn. 06480

[21] Appl. No.: 315,474

[22] Filed: Feb. 24, 1989

[51] Int. Cl.[5] ..... A47C 3/00

[52] U.S. Cl. ..... 297/457; 297/445; 297/421

[58] Field of Search ..... 297/445, 446, 457, 421

[56] References Cited

U.S. PATENT DOCUMENTS

| | | | |
|---|---|---|---|
| D. 169,299 | 5/1951 | Willemin . | |
| D. 182,813 | 5/1958 | Golden et al. . | |
| D. 183,790 | 10/1958 | Deaton et al. . | |
| D. 192,855 | 5/1962 | Mengel . | |
| D. 194,497 | 2/1963 | Miller . | |
| D. 194,498 | 2/1963 | Miller . | |
| D. 197,513 | 2/1964 | Crawford . | |
| D. 210,940 | 5/1968 | Eames . | |
| D. 244,811 | 6/1977 | Sternfield . | |
| D. 288,993 | 3/1987 | Grimsrud . | |
| D. 292,247 | 10/1987 | Grimsrud . | |
| 2,215,540 | 9/1940 | Breuer . | |
| 2,439,322 | 4/1948 | Thaden . | |
| 2,670,787 | 3/1954 | Vandas et al. | 297/457 |
| 2,696,869 | 12/1954 | Schlaak | 297/457 X |
| 2,847,061 | 8/1958 | Morton . | |
| 3,038,175 | 6/1962 | Faget et al. . | |
| 3,115,366 | 12/1963 | Glass . | |
| 3,447,170 | 6/1969 | Spitz | 247/457 X |
| 3,711,878 | 1/1973 | George et al. . | |
| 3,729,227 | 4/1973 | Ohta . | |
| 3,762,767 | 10/1973 | Powell . | |
| 4,027,888 | 6/1977 | Wilcox | 297/456 X |
| 4,064,376 | 12/1977 | Yamada . | |
| 4,124,249 | 11/1978 | Abbeloos . | |
| 4,230,365 | 10/1980 | Messinger . | |
| 4,277,103 | 7/1981 | Weik . | |
| 4,594,817 | 6/1986 | McLaren . | |
| 4,605,261 | 8/1986 | Lee | 297/457 X |

FOREIGN PATENT DOCUMENTS

| | | | |
|---|---|---|---|
| 672824 | 1/1930 | France | 297/130 |
| 2568458 | 2/1986 | France | 297/457 |
| 713376 | 7/1965 | Switzerland | 297/457 |
| 436606 | 11/1967 | Switzerland | 297/457 |

*Primary Examiner*—Peter R. Brown

*Attorney, Agent, or Firm*—Fishman, Dionne & Cantor

[57] ABSTRACT

A chair or couch is presented which supports the person using it in a predetermined relaxation position. The position merges the neutral body position (the position the body takes in zero gravity) with the savasana yoga position (the position used for thousands of years by yogi to reach enhanced meditative relaxation). The chair of the present invention is characterized by a pre-selected profile configuration and a preselected ventral configuration. In profile, the user's body takes on the angles found in the profile of the neutral body position. In the ventral view, the user's body has the same angles as in the savasana yoga position.

7 Claims, 6 Drawing Sheets

PROFILE

VENTRAL

NEUTRAL BODY POSTURE

PRESENT INVENTION

SAVASANA

DERIVATION OF FLOGISTON POSTURE

PROFILE

VENTRAL

CUSHION

TYPICAL CHAIR STRUCTURE

NON CONTACTING BIOFEEDBACK TOPOLOGY

RELAXATION CHAIR

BACKGROUND OF THE INVENTION

This invention relates to the field of chairs or couches. More particularly, this invention relates to a couch or chair for supporting a human occupant in a predetermined posture which reduces both physical and mental stress thereby allowing for enhanced work productivity.

Present day work environments are based on traditional methods of dealing with paper data bases. Books, ledgers, papers and the like are often scattered around a work surface located at a suitable height for a person sitting upright. As electronic displays have been introduced into the workplace, these displays have been added to the desk top as a device which had to coexist with, rather than replace, the paper database This phenomenon has lead to numerous side effects to workers resulting from occupational stress which effectively reduces the very productivity improvements which the automation was intended to bring. Office workers have blamed the video display units for eye strain, muscular discomfort, backaches, emotional disorientation, anxiety and a general increase in stress levels.

However, it has been determined that many of these problems stemmed not from the video display unit, but from the physical relationship with the terminal. For example backache may be traced to poor posture, eye strain may be due to poor lighting and screen reflections, and stress may result from the intrusion of a video display unit in a work environment designed for paper management. These problems all result in an overall decrease in work productivity.

The chairs presently available for use in conjunction with electronic work stations have improved somewhat over the past ten years. These chairs offer improved ergonomics, aesthetics and modern materials. However, such contemporary chairs do not directly improve the work environment, but only aid in the worker's posture and comfort.

SUMMARY OF THE INVENTION

The above-discussed and other problems and disadvantages of the prior art are overcome by the chair or couch of the present invention. In accordance with the present invention, a couch is presented which supports the body in a relaxed posture. This Posture results in the worker enjoying enhanced improved overall concentration. The predetermined posture provided by the couch of the present invention is derived from the posture of a body in zero gravity (neutral body position) and the posture of a body in the savasana yoga position.

In zero gravity, no external forces act on the body, the muscles realign the posture so that the internal muscular forces are in equilibrium. The legs bend and float apart, the feet droop, the back curves, arms float up and away from the body, and the neck muscles bend the head forward. At rest, there are no internal or external forces acting on the body.

The yoga position of meditation called savasana (e.g. the corpse pose), has been practiced for thousands of years. In this position, the yogi lies flat on his back, with his body perpendicular to gravity's pull, and his legs and arms spread apart. The yogi then performs a combination of rhythmic breathing, stretching and relaxation exercises.

The posture achieved by the chair of the present invention combines the neutral body position and the savasana body Position to produce a compromise position with gravity. Essentially, the chair of this invention supports the body so that the side view approximates the neutral body position, and the plan view reproduces the savasana position.

By lying in the couch, the user adopts the position of relaxation. The users legs are apart, the feet are dangling, the arms are resting along the arm rests, the body is reclining at 30° and the head is looking upwards. In this relaxed Position, the user can remain focused on a particular task for a much longer period of time.

If the user works for long periods of time at a video display unit, the couch of the present invention can help maintain the user's mental focus for greater lengths of time. This enhances the user's productivity and the productivity of the computer system. A feedback system which measures the user's level of stress may also be incorporated in the couch. This stress measurement system is based on the user's heart beat, body movements, breathing rate and the like. If, based on the user history, any of these measurements reach a predetermined level, relaxing music or a relaxation video tape will be provided to optimize the stress level.

The couch of the present invention consists of two principle parts including a suspension structure and a supporting cushion. The suspension structure provides a mechanical support system and the predetermined posture for the user. The cushion is cut from one piece of long memory foam and covered with soft material such as vinyl or leather. At first, the foam feels firm, but as it responds to body heat and pressure, it softens and the foam feels as if it is molding to the body. All human parts in contact with the chair are supported by the foam cushion.

The couch can be custom built to match the size and shape of the user and yet be produced at a reasonable cost. Modern manufacturing technology can be employed to custom produce the chair to the requisite parameters of the user/purchaser.

The above-discussed and other features and advantages of the present invention will be apparent to and understood by those skilled in the art from the following detailed description and drawings.

BRIEF DESCRIPTION OF THE DRAWINGS

Referring now the the drawings, wherein like elements are numbered alike in the several FIGURES.

DESCRIPTION OF THE PREFERRED EMBODIMENT

Figure 1:
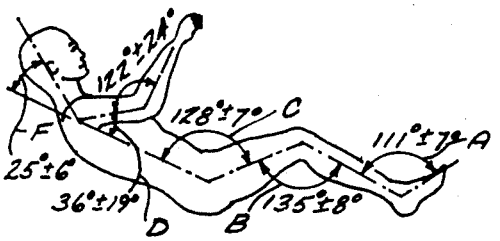
FIG. 1 is a profile view of a human body in the neutral body position.
Figure 2:
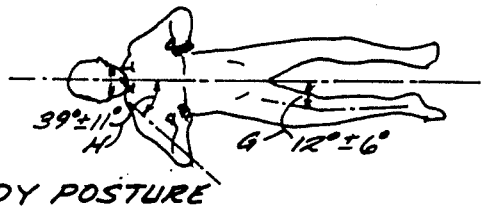
FIG. 2 is a ventral view of a human body in the neutral body position of FIG. 1.

Referring first to FIGS. 1 and 2, a human body is shown in the neutral body position or posture. This is the position the body takes when it is relaxed in a zero gravity environment. In zero gravity, no external forces act on the body. As a result, the muscles realign the posture so that internal muscular forces are in equilibrium. In the neutral body posture, the legs bend and float apart, the feet droop, the back curves, the arms float up and away from the body, and the neck muscles bend the head forward. When at rest there are no internal or external forces acting on the body. It will be appreciated that astronauts who have experienced zero gravity have expressed a deep sense of relaxation when floating in this physical equilibrium (sometimes for hours at a time).

Still referring to FIG. 1, in the neutral body posture (e.g. a relaxed state in zero gravity), an angle A is formed between the foot and the calf, with its axis point at the ankle. Angle A measures about 111°±7°. An angle B is formed between the calf and the thigh, with its axis point at the knee. Angle B has a measurement of about 135°±8°. An angle C is formed between the thigh and the torso, with its axis point at the hip. Angle C has a measurement of about 128°±7°. An angle D is formed between the upper arm and the torso, with its axis point at the shoulder. Angle D has a measurement of about 36°±19°. An angle E is formed between the forearm and the upper arm, with its point of axis at the elbow. Angle E has a measurement of about 122°±24°. An angle F is formed between the neck and the torso, with its point of axis at essentially the shoulder. Angle F has an angle of 25°±6°.

Referring to FIG. 2, an angle G is formed between the central axis of the body (the line which runs from the nose, to the belly button, to the crotch) and the thigh. Angle G has a measurement of about 12°±6°. An angle H is formed between the central axis line and the upper arm. Angle H has a measurement of about 39°±11°.

Figure 3:
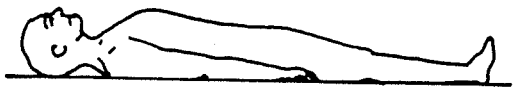
FIG. 3 is a profile view of a human body in the yoga savasana position.
Figure 4:
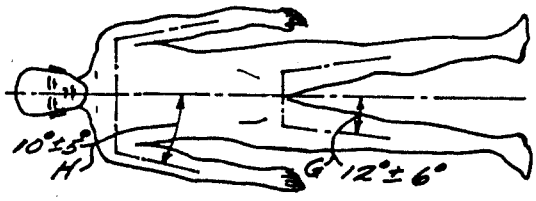
FIG. 4 is a ventral view of a human body in the yoga savasana position of FIG. 3.

Referring now to FIGS. 3 and 4, a representation of a human body is shown lying in the yoga savasana position. This position (also called the corpse pose) is a yoga position of meditation used for thousands of years. In this position, the yogi lies flat on his back, with his body perpendicular to gravity's pull, and his legs and arms spread comfortably apart. At this point, the yogi performs a combination of rhythmic breathing, stretch and relaxation exercises. The result is a state of enlightened relaxation that is both meditative and exhilarating; and which can be maintained for prolonged periods of time. It will be appreciated that the savasana position of FIGS. 3 and is the equivalent of the neutral body position of FIGS. 1 and 2 in a gravitational environment. The force of gravity comprises the relaxation which can be achieved in a zero gravity environment. In essence, the savasana position is a two dimensional relaxation position rather than a three dimensional relaxation position. In other words, in savasana position, the body is forced by gravity to lie flat, rather than in the folded position of the Neutral Body posture. Comparing the posture of FIGS. 1, 2 to the posture of FIGS. 3, 4, it will be appreciated that while the difference in respective angles A–F are quite distinct, angle G of FIG. 4 (having a measurement of 12°±6°) is substantially the same as angle G in the neutral body position. Angle H in FIG. 4 is 10°±5°, while angle H of FIG. 2 is 39°±11°. This difference is a direct result of the effect of gravity.

Figure 5:
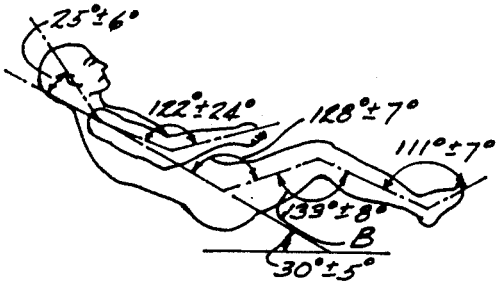
FIG. 5 is a profile view of a human body as seated in the couch or chair of the present invention.
Figure 6:
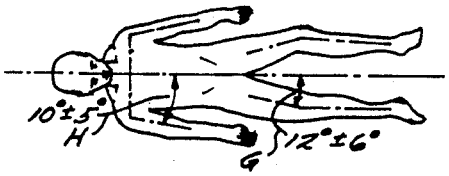
FIG. 6 is a ventral view of the human body as seated in the couch or chair as shown in FIG. 5.

Now referring to FIGS. 5 and 6, a human body is shown as it would be positioned in a couch or chair produced in accordance with the present invention. The couch or chair of the present invention supports the human body in a manner that merges or combines the neutral body position of FIGS. 1 and 2 and the savasana position of FIGS. 3 and 4 to produce a compromise posture. The chair or couch is designed for use in a gravitational field. It will be appreciated that the gravitational field can range in gravitational force from 0 upwards. However, the couch of the present invention creates a profiled posture in which only slight differences exist between it and the body in the neutral body posture. In the posture of the present invention, angle B varies about 2° and angle D varies about 36°. In essence, the body while seated in the couch of the present invention, has the profiled orientation of a body at rest in a zero-gravity environment, while in the ventral (plan) view the body as shown in FIG. 6 has identical angles G and H as does the body in the savasana position shown in FIG. 4.

It will be appreciated that the couch of the present invention provides the three-dimensional relaxation of zero gravity, yet utilizes the time tested yoga savasana position used in a gravity environment to achieve a couch which provides maximum relaxation while in a gravitation environment.

Referring now to FIGS. 7-17, a couch in accordance with the present invention will now be described in detail. The preferred embodiment of the couch of the present invention is shown generally at 10 in FIGS. 13-17. Couch 10 comprises a frame 12 and a cushion 14. It will be noted that from the top view (FIGS. 11, 12 and 13), couch 12 has a wedge configuration, narrow at the head and wide at the feet, so that the user's legs and arms can be spread apart.

Frame structure 12 provides the mechanical support system for cushion 14 which, in turn, provides the necessary posture for the user. Frame 12 preferably consists of two sheets of aluminium 15*a* and 15*b* which mate together at a seat 16, and are held in place with a plurality of fasteners 18. Fasteners 18 fasten a pair of arm rests 20 to a back rest 22. A tension cable 24 is positioned between sheets 15*a* and 15*b* at ground level to balance the forces in structure 12. Structure 12 has a certain degree of elasticity which enables a limited amount of rocking to take place about a fulcrum 26 located at the base of the users spine. Couch or chair 10 will respond to movement imparted by the user and provide a limited but gentle rocking motion.

In a preferred embodiment sheet 15*a* includes a slot 17 which receives a tab 19 from sheet 15*b*. Tab 19 and a lower portion 21 of sheet 15*a* together form the support legs for frame 12. Arms are integral to sheet 15*b* and are attached by fasteners 18 to sheet 15*a* (see FIG. 14). Preferably, sheets 15*a* and 15*b* are made of aluminium which is anodized to a military specification in black. Alternatively, sheets 15*a* and 15*b* may be comprised of other materials (e.g. wood or other metals) which may or may not be painted or otherwise coated. This provides long term protection against scraping and corrosion, and allows the chair structure to be left outside. Fasteners 18 and cable 24 are preferably made from stainless steel or toher non-corrosive materials.

Cushion 14 should preferably be cut from a single piece of long memory foam and covered with a soft flexible synthetic or natural material such as leather. Cushion 14 can include a head rest 15. Preferably, foam 14 comprises a foamed polymeric material such as CONFOR FOAM manufactured by Specialty Composites, Inc. Long memory foam initially feels firm, but as it responds to body's heat and pressure, the foam softens and feel as if it is molding to the body. Thus, cushion 14 distributes pressure equally over the contact surface of the body and reduces or eliminates pressure points.

It will be appreciated that the combination of distributed pressure loading and absence of pressure points enables the body to remain immobile for prolonged periods of time. Use of memory foam also reduces the need for thick layers of foam, so that the cushion need only have a thickness of about one inch. This reduces material cost and enhances the aesthetics of chair 10. Long memory foam is surface sealed, so it is pleasant to the skin. Thus, cushion 14 could be sold without a cover, although a cover is preferred, if memory foam is used as the cushion material.

Figure 7:
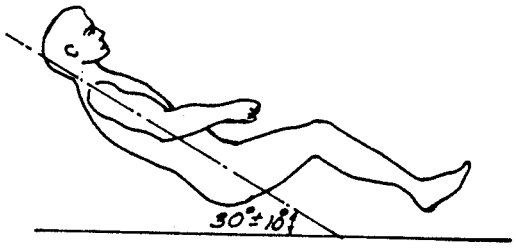
FIG. 7 is the profile view of a human body shown in FIG. 5.
Figure 10:
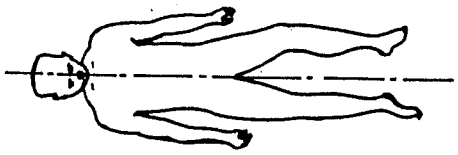
FIG. 10 is a ventral view of the human body of FIG. 5.
Figure 8:
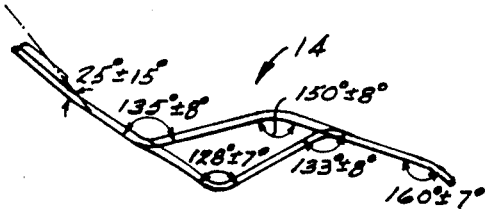
FIG. 8 is a side elevation view of a cushion for the couch of the present invention.
Figure 11:
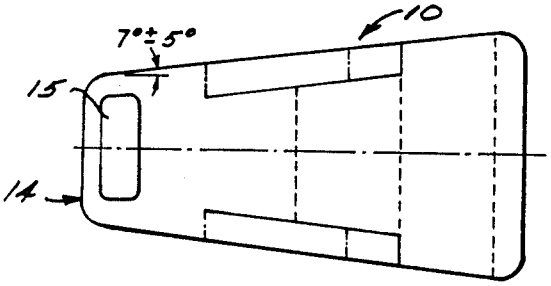
FIG. 11 is a top elevation view of the cushion of FIG. 8.
Figure 9:
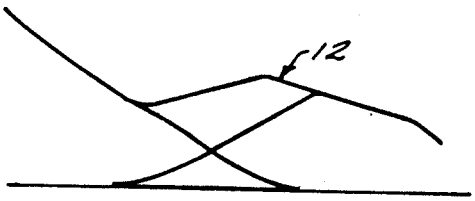
FIG. 9 is a side elevation view of a frame for the couch of FIG. 8.
Figure 12:
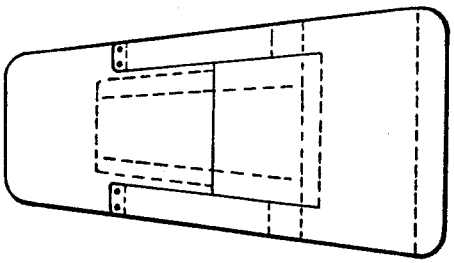
FIG. 12 is a top elevation view of the frame of FIG. 9.
Figure 13:
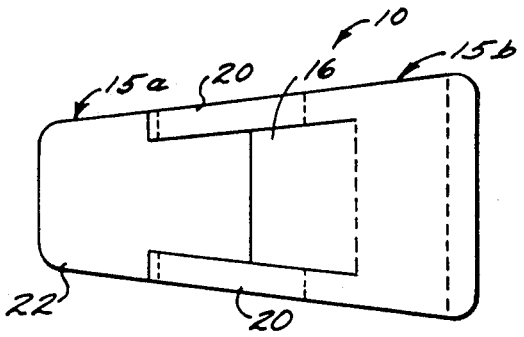
FIG. 13 is a top elevation view of the couch of the present invention.
Figure 14:
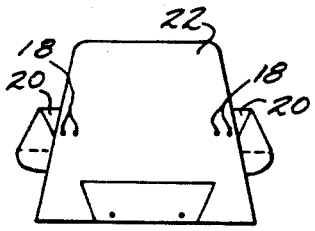
FIG. 14 is a back elevation view of the couch of FIG. 13.
Figure 15:
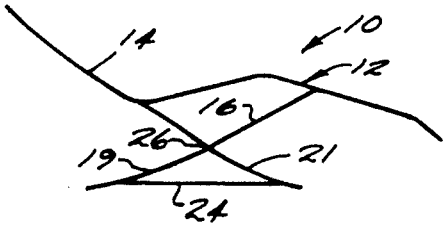
FIG. 15 is a side elevation view of the couch of FIG. 13.
Figure 16:
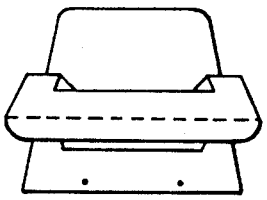
FIG. 16 is a front elevation view of the couch of FIG. 13.
Figure 17:
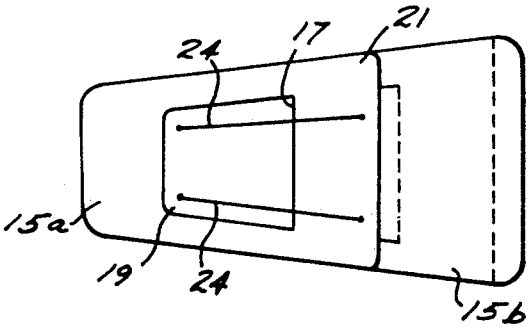
FIG. 17 is a bottom elevation view of the couch of FIG. 13.
Figure 18:
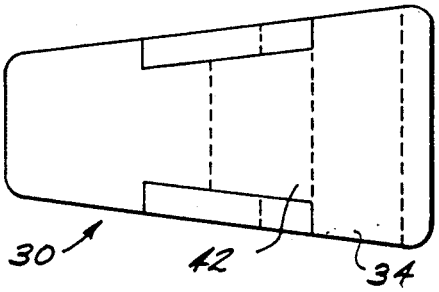
FIG. 18 is a top elevation view of an alternate embodiment of the couch of the present invention.
Figure 19:
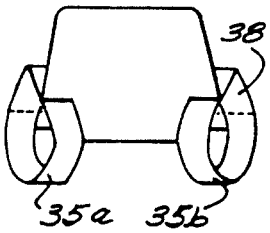
FIG. 19 is a back elevation view of the couch of FIG. 18.
Figure 20:
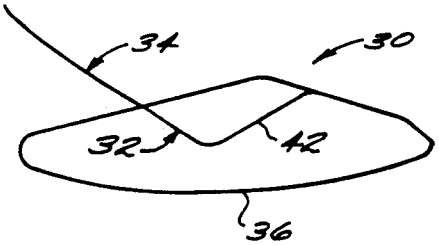
FIG. 20 is a side elevation view of the couch of FIG. 18.
Figure 21:
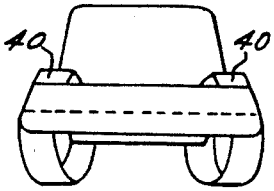
FIG. 21 is a front elevation view of the couch of FIG. 18.
Figure 22:
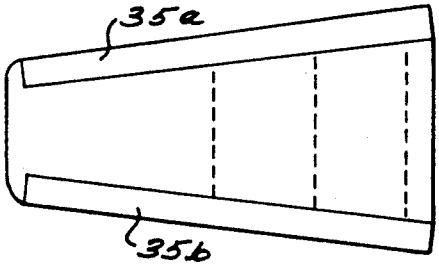
FIG. 22 is a bottom elevation view of the couch of FIG. 18.
Figure 23:
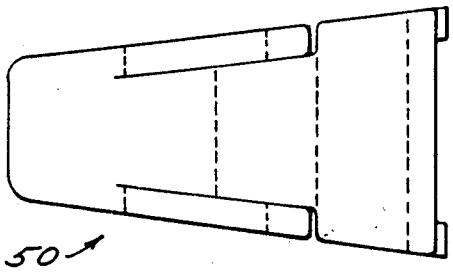
FIG. 23 is a top elevation view of another alternate embodiment of the couch of the present invention.
Figure 24:
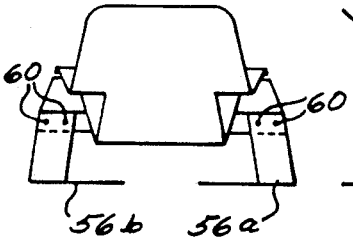
FIG. 24 is a back elevation view of the couch of FIG. 23.
Figure 25:
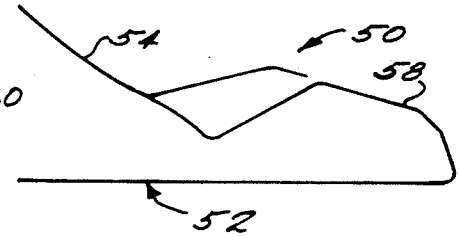
FIG. 25 is a side elevation view of the couch of FIG. 23.
Figure 26:
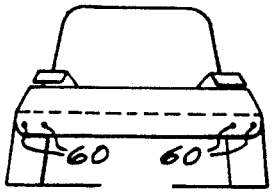
FIG. 26 is a front elevation view of the couch of FIG. 23.
Figure 27:
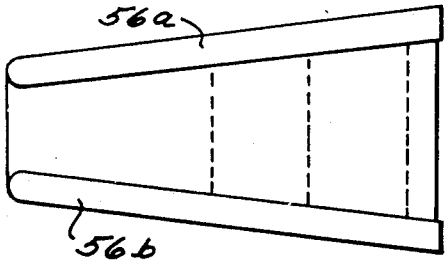
FIG. 27 is a bottom elevation view of the couch of FIG. 23.

Referring to FIGS. 7-9 it can be seen how cushion 14, frame 12 and the human body merge together. Cushion 14 is separable from frame 12. Cushion 14 is simply laid on top of frame 12 and is held in place with Velcro straps (not shown) or some other like fastening means. Thus, cushion 14 can be easily removed for cleaning, changed to match decor, or upgraded to a higher quality covering material. Cushion 14 may also be removed and used as a floor mat. Cushion 14 may also be transferred to different structures such as shown in FIGS. 13-27.

It will be appreciated that other support structures may be incorporated into the present invention to provide individualized ergonomics. These additional support structures include, but are not limited to, ergonomically shaped head and neck rests, inflatable lumbar support balloons, and other secondary products.

It is noted that frame 12 is designed individually so as to provide the proper posture shown in FIGS. 5 and 6. Frame 12 and cushion 14 are angled in a manner to achieve the ideal posture as seen in FIGS. 8 and 9.

Referring now to FIGS. 18-22, an alternate embodiment of the couch of the present invention is shown generally at 30. Couch 30 provides the angular orientation of couch 10 which will support the user in the manner contemplated in FIGS. 5 and 6 (i.e. the cross between the neutral body position of zero gravity and the yoga savasana position of a gravity environment). Couch 30 also comprises a frame 32 and cushion 34. Cushion 34 is identical to cushion 14 of couch 10 and is attached to frame 12.

Frame 32 of couch 30 differs in several respects from frame 12 of couch 10. Frame 32 uses flat elongated sheets 35*a* and 35*b* as a base 36. Sheets 35*a* and 35*b* are slightly arched to provide couch or chair 30 with a slight rocking motion.

Frame 32 is constructed of three pieces including base sheets 35*a*, 35*b* and seat section 40. Base sheets 35*a* and 35*b* are each flattened elongated sheets of metal, preferably anodized aluminium as discussed above, joined at the ends to form an irregular shaped ring. Located directly above base 36 is an arm section 40. Arm section 40 is the section of couch 30 on which the arm of the user rests.

A seat section 42 comprises the remainder of frame 32. Seat section 42 is the section of frame 32 on which the body of the user rests. Section 42 is bent at angles to support the users body in the posture shown in FIGS. 5 and 6.

It will be appreciated that the configuration of chair 30 allows a user to rock slightly while he or she relaxes. In some instances, this may further deepen his concentration.

Referring now to FIG. 23-27, yet another alternate embodiment of the couch of the present invention is shown generally at 50. Couch 50 is comprised of a frame 52 and a cushion 54. Cushion 54 is fundamentally the same as cushions 14 and 34 while the Frame 52 of couch 50 will place the user's body in the posture of FIGS. 5 and 6. Frame 52 also differs from frames 12 and 32. Frame 52 has two independent legs 56*a* and 56*b* which support main chair frame 58. Legs 56*a* and 56*b* are attached to main chair frame 58 at the front of couch 50. Legs 56*a* and 56*b* are attached by a plurality of fasteners 60 to frame 58. Thus, while the user sits in chair 50, he or she will experience a certain springiness caused by the manner in which frame 52 is assembled.

While several embodiments of the chair of the present invention have been described, several more embodiments are easily envisioned. Thus, an important feature of this invention is not how the chairs or couches are assembled, but rather that the chair and cushion assembly support the users body as contemplated in FIGS. 5 and 6.

Still another feature of the chair of the present invention is the provision of reduced load on the user's spine.

Accordingly, the present invention will assist in the reduction of back pain.

Figure 28:
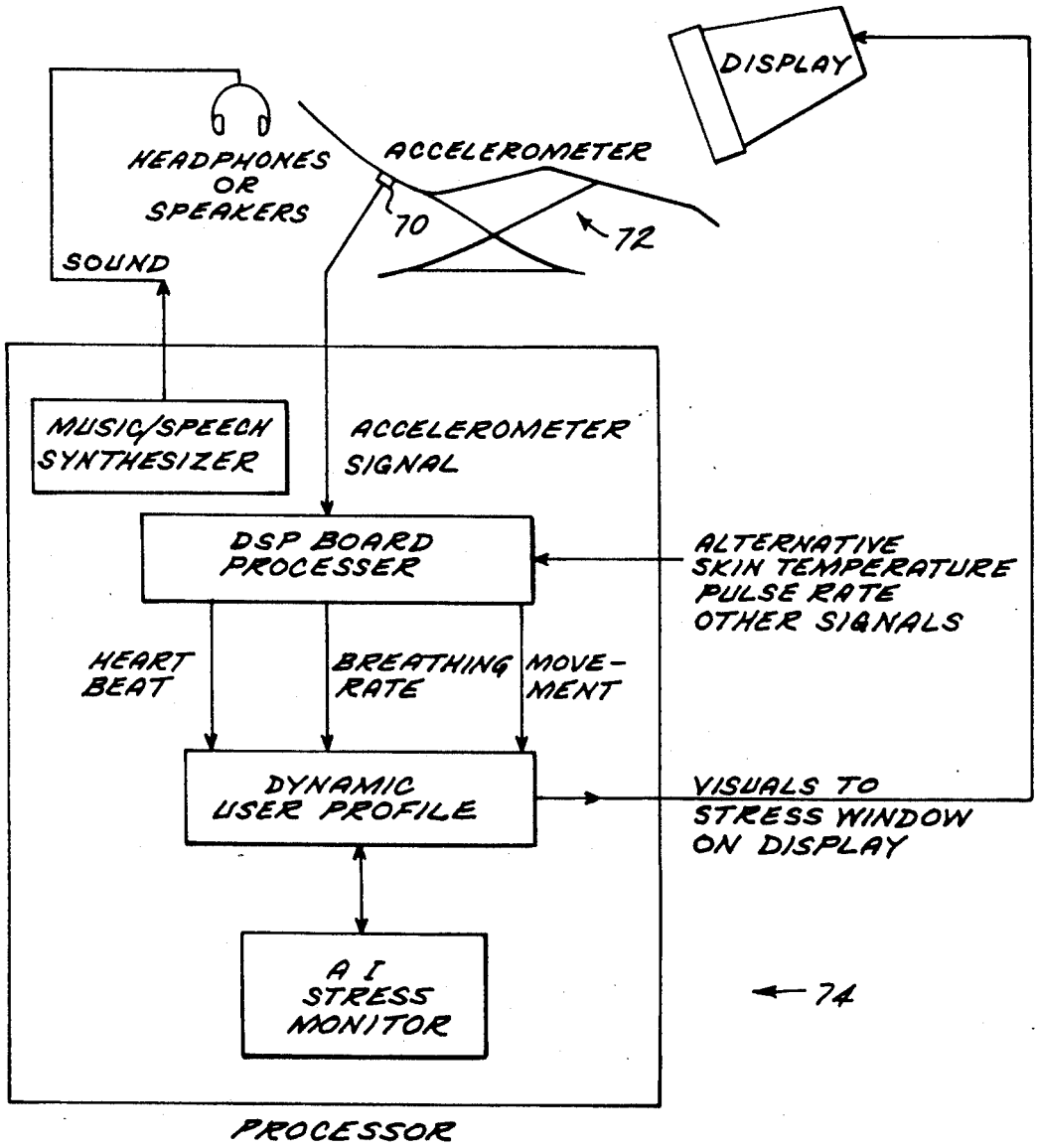
FIG. 28 is a diagram of a bio-feed back loop for use with the couch of the present invention.

Some additional accessories are contemplated for use with the chair of this invention in addition to those previously mentioned. An important accessory which aids in relaxation is a bio-feed back system as shown in FIG. 28. In the system of FIG. 28, an accelerometer or similar transducer 70 is attached to the back of chair 72. Accelerometer 70 measures movements, such as chair movements, breathing rate, heart beat and the like. These measurements are compared against a historic collection of measurements stored in a microprocessor 74. A positive increase in the number of movements, breathing rate, or heart beat, signal the chair user is under stress. Once determined the user is under stress, microprocessor 74 signals a video recorder, software program or a music/speech synthesizer to begin showing user relaxing visual displays and providing the user with relaxing music. As the user's movement, breathing rate, and heart beat are optimized, the stimulation is removed and the user can continue to relax and work at a computer screen if preferred.

The accelerometer/processor system can also be used for non-contacting patient monitoring of breathing rate, heart beat and the like, for use in patient care in hospitals, rest homes, etc.

The apparatus of the present invention can be manufactured by standard mass production methods. An alternate method involves collecting anthropomorphic data from the user, and using this data to custom build the chair or couch.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A chair for supporting a human body, said body including a head, a torso, a pair of legs and a pair of arms, said arms each having an upper portion and a lower portion, and said legs each having an upper portion and a lower portion, wherein said body may be oriented in a neutral body position characterized by predetermined first relative angular positions of the head, torso, upper leg portions, lower leg portions, upper arm portions, and lower arm portions or in a savasana yoga position characterized by predetermined second relative angular positions of the head, torso, upper leg portions, lower leg portions, upper arm portions, and lower arm portions, comprising:

rigid sheet means for supporting said body, said rigid sheet means comprising:

first support means for supporting the head, torso and legs of the body in predetermined relative angular positions that substantially correspond to the first relative angular positions of the head, torso and legs; and second support means for supporting the arms in predetermined angular positions relative to the torso that, in a ventral view of the body, substantially correspond to the second relative angular positions of the arms and torso and supporting said lower portions of the arms in predetermined angular positions relative to the upper arms that, in a profile view of the body, substantially correspond to the first relative angular positions of the upper and lower portions of the arms;

said rigid sheet means exhibiting, in a top view of the chair, a trapezoidal configuration extending from a narrow end for supporting the head to a wide end for supporting the lower portions of the legs; and cushion means for cushioning said rigid sheet means.

2. The claim of claim 1, wherein the rigid sheet means comprises an aluminum rigid sheet means.

3. The chair of claim 1, wherein said rigid sheet means further comprises third support means for positioning the first and second support means relative to a substrate.

4. The chair of claim 1, wherein said first and second support means comprise a single rigid piece and said second support means are defined by being partially cut and folded away from said first support means.

5. The chair of claim 1 wherein the cushion means comprises memory foam means for conforming to the contours of the human body.

6. The claim of claim 1, wherein the predetermined relative angular positions comprise:

an angle of 25°±6° between the head and torso of the body in a profile view of the body;

an angle of 128°±7° between the upper leg portion and torso of the body in a profile view of the body;

an angle of 133°±8° between the upper leg portion and the lower leg portion of the body in a profile view of the body;

an angle of 122°±24° between the upper arm portion and lower arm portion of the body in a profile view of the body;

an angle of 10°±5° between the upper arm portion and said torso of the body in a ventral view of the body.

7. A chair, comprising:

rigid sheet means for supporting a human body, said rigid sheet means comprising;

back support means extending from a top end to a bottom end at an angle, in a longitudinal side view of the chair, or 30°±50° relative to a horizontal substrate;

head support means extending from the top end of said back support means at an angle, in a longitudinal side view of the chair, of +25°±15° relative to said back support means;

upper leg support means extending from the bottom end of said back support means at an angle, in a longitudinal side view of the chair, of +128°±7° relative to said back support means;

lower leg support means extending from said upper leg support means at an angle, in a longitudinal side view of the chair, of −133°±8° relative to said upper leg support means;

arm support means having a first portion extending from said back support means at an angle, in a longitudinal side view of said chair, of +135°±8° relative to said back support means, a downwardly curving transitional portion and a second portion extending between the transitional portion and the lower leg support means at an angle, in a longitudinal side view of said chair, of 150°±8° relative to said first portion; and;

base means for supporting the rigid sheet means on the horizontal substrate;

said rigid means exhibiting, in a top view, a trapezoidal configuration and having an axis of bilateral symmetry wherein said head support means forms a narrow transverse edge of said sheet means perpendicular to said axis of bilateral symmetry, said lower leg support means forms a wide transverse edge of said sheet means perpendicular to said axis of bilateral symmetry and a pair of longitudinal edges extend from between said narrow edge to said wide edge at diverging angles of 7°±5° relative to the axis of bilateral symmetry.

* * * * *